US005640839A

United States Patent [19]

Novotny et al.

[11] Patent Number: 5,640,839

[45] Date of Patent: Jun. 24, 1997

[54] METHOD OF SPINNING-IN YARN ON OPEN-END SPINNING MACHINES USING A PRESSURIZED AIR FEED AND A DEVICE FOR CARRYING OUT THE METHOD

[75] Inventors: Vojtech Novotny; Zdenek Spindler, both of Usti nad Orlici, Czech Rep.

[73] Assignee: Rieter Elitex a.s., Czech Rep.

[21] Appl. No.: 385,322

[22] Filed: Feb. 8, 1995

[30] Foreign Application Priority Data

Feb. 10, 1994 [CZ] Czech Rep. ..... 292-94

[51] Int. Cl.[6] ..... D01H 11/00

[52] U.S. Cl. ..... 57/301; 57/263; 57/304; 57/406; 57/411; 57/412

[58] Field of Search ..... 57/261, 263, 301, 57/302, 304, 406, 411, 412

[56] References Cited

U.S. PATENT DOCUMENTS

| | | | |
|---|---|---|---|
| 405,942 | 11/1890 | Stahlecker | 57/412 |
| 3,800,520 | 4/1974 | Schiltknecht | 57/411 |
| 3,986,327 | 10/1976 | Kobayashi | 57/301 |
| 4,036,002 | 7/1977 | Kobayashi | 57/301 |
| 4,038,812 | 8/1977 | Stahlecker | 57/302 |
| 4,041,687 | 8/1977 | Motobayashi et al. | 57/304 |
| 4,059,946 | 11/1977 | Bottcher | 57/263 |
| 4,249,370 | 2/1981 | Vecera et al. | 57/301 |
| 4,384,451 | 5/1983 | Elias et al. | 57/263 |
| 4,676,059 | 6/1987 | Artzt | 57/263 |
| 4,700,431 | 10/1987 | Artzt et al. | 57/411 |
| 5,343,686 | 9/1994 | Buchner et al. | 57/263 |
| 5,454,219 | 10/1995 | Raasch | 57/304 |

FOREIGN PATENT DOCUMENTS

| | | |
|---|---|---|
| 0374982 | 6/1990 | European Pat. Off. . |
| 0374983 | 6/1990 | European Pat. Off. . |
| 3436295 | 4/1985 | Germany . |

*Primary Examiner*—William Stryjewski

*Attorney, Agent, or Firm*—Ostrolenk, Faber, Gerb & Soffen, LLP

[57] ABSTRACT

A method of spinning-in yarn on open-end spinning machines in which an interruption of the spinning process is followed by the stop of the feed of the sliver (4) into the singling-out device (2) whose combing roller (22) keeps turning, and the rotor is stopped at least during its cleaning. When the rotor (1) has re-started the yarn end is returned to it and brought into contact with the newly formed fiber band. Prior to the re-starting of the rotor (1) and at the latest simultaneously with the start of the feed device (3) of the sliver (4), the surface of the combing roller (22) is acted upon by a pressure air stream acting in the sense of rotation of the combing roller (22) between the place of supply of the sliver (4) to the combing roller (22) and the mouth of the fiber feed channel (212) to the rotor (1) so as to remove from the clothing (221) of the combing roller (22) fibers and sticking impurities. The invention also relates to a device for carrying out the method.

12 Claims, 4 Drawing Sheets

METHOD OF SPINNING-IN YARN ON OPEN-END SPINNING MACHINES USING A PRESSURIZED AIR FEED AND A DEVICE FOR CARRYING OUT THE METHOD

BACKGROUND OF THE INVENTION

1. Field of the Invention:

The invention relates to a method of spinning-in yarn on open-end spinning machines in which an interruption of the spinning process is followed by the stop of the sliver feed into the singling-out device whose combing roller keeps turning, and the rotor is stopped at least during its cleaning, and when the rotor has re-started the yarn end is returned to it and brought into contact with the fiber band being formed.

The invention also relates to a device for carrying out the method provided in the singling-out device of the spinning unit of an open-end spinning machine. The singling-out device comprises a body carrying therein a rotatably mounted combing roller around whose cylindrical surface, fitted with a clothing, there is provided a fiber transport channel, followed by a supply channel for feeding the fibers into the rotor, and in which there is related to the combing roller a sliver feed device for supplying a silver to the fiber transport channel.

The device for carrying out the method according to the invention can be applied on open-end spinning machines, both with an active rotor having ventilation apertures and producing underpressure by means of its own rotation, and with a passive rotor, without ventilation apertures, seated in an underpressure chamber connected to an underpressure source.

2. Description of the Related Art:

In open-end spinning machines, the spinning process must be resumed after each yarn interruption on each spinning unit. Yarn interruptions are caused, for example, by yarn rupture or the exchange of an empty bobbin for a full bobbin. Spinning is resumed by inserting the yarn end into the rotor of the spinning unit where the fibers deposited in the known way on the collecting surface of the rotor are connected to this yarn end and the draw-off motion of the yarn starts the process of continuous spinning. This whole process is called spinning-off.

Open-ended spinning machines can be divided into two types, depending on the way in which underpressure is produced: (1) those with active rotors fitted with ventilation apertures for producing underpressure in the rotor by means of its own rotation; and (2) those with passive rotors in which underpressure is generated by placing the rotor in an underpressure chamber connected to an underpressure source. Although the spinning-in operation in these two types show some differences, the feature common to both of them is that, after the interruption of the spinning on a spinning unit, the related combing roller keeps rotating, while the sliver feed is stopped. As a result, the rotating combing roller loosens fibers from the sliver end section, or also tears or breaks away parts thereof, and this process goes on for an indefinite time interval or until a servicing device comes. If the spinning-in is carried out on a fiber band made of a thus-damaged fiber end section, the quality of the spinning-in connecting section is poor, and the number of ineffective spinning-in attempts increases. A low quality spinning-in connecting section impairs the yarn suitability for its further processing in the textile industry, for instance in the knitting industry, because it leads to ruptures of the yarn while being processed, or to aesthetic defects of the final products.

The problem of producing a high quality spinning-in connecting section can be solved by tilting the sliver condenser of the feed device away from the combing rotor, but this solution is so complicated in design and production that it has not found acceptance.

CS 227 602 has disclosed a method of spinning-in yarn on an open-end spinning machine with a spinning rotor before which there is placed a singling-out device with a sliver feed device and with a combing roller. The spinning-in device returns the yarn into the spinning rotor for connecting it to the fiber band produced in the collecting groove of the rotor by re-starting the feed device that was put out of operation in the preceding phase, whereupon the yarn is again drawn-off from the spinning rotor. The spinning-in process is started after the rotor has been cleaned. The fibers contained in the fiber end section gripped in the feed device are led away from the transport path of fibers between the feed device and the spinning device so as to be completely removed from the spinning-in process.

The above method of spinning-in is, however, only a goal up to now not obtained by any device, because the leading of the fibers away from the fiber transport path is carried out after the spinning rotor has been cleaned, i.e., at a time when the spinning rotor already turns and, since it is an active rotor, its ventilation apertures produce underpressure while turning.

The fundamental condition for the device to function is the elimination of the underpressure in the rotor. This may be obtained in either of two ways, either by increasing the underpressure in the waste channel intended to lead the waste away from the transport path of the fibers, or by closing the fiber supply channel intended to feed the fibers from the combing roller into the rotor, for instance by applying the air stream to the supply channel in the direction opposite to the fiber flow, as described in CS AO 227 602. The production and technological application are so complicated that they have not permitted the use of this method in practice.

An improvement of this method was intended by the solution described in DE OS 34 36 295 in which the waste channel in the singling-out device reaches as far as the front side of the singling-out device. An aperture in the front side of the singling-out device can receive an ancillary suction tube having an aperture matching with the waste channel in the final position of said suction tube. The inner space of the suction tube is connected to an underpressure source feeding the fibers presented from the clothing of the combing roller. The chief drawbacks of this device are its ambiguity and the difficulty to obtain the exact mutual position of the components required in order to avoid irregularities in the introduction of the tube into the waste channel.

Another solution to the problem consists in sucking away the damaged fibers through the waste channel or through a special suction channel prior to the spinning-in proper. The feed device is started for a predetermined time interval so as to carry out a kind of pre-feed of the sliver. It is then stopped, the damaged fibers are sucked away, and only then does the spinning-in process properly begin.

Such a device has been further improved by EP 374 982 A1, in which the suction tube is laid to the front side around the suction channel mouth. Its drawback consists in the imperfect sealing of the connection on the front side of the spinning unit and in the necessity to suck away considerable amounts of air requiring a correspondingly mighty underpressure source.

Another improvement is described in EP 374 983 A1, in which a tube for supplying pressurized air into the suction channel is connected to the mouth of the suction channel. The pressurized air produces, at the place of the waste channel mouth, an injection action in consequence of which the fibers are sucked off from the clothing of the combing roller during the sliver pre-feed.

This solution also puts heavy requirements on the pressurized air source. Like all preceding solutions, this method cannot remove from the combing roller clothing all impurities and fiber rests.

For passive rotors, a method of spinning-in yarn on open-end spinning machines has been described in U.S. Pat. No. 4,059,946, in which the yarn end is put back to the spinning rotor running in an underpressure chamber, placed on the fiber band being produced in the rotor from the singled-out fibers being supplied, connected to the fiber band, and drawn-off. For producing a fiber band suitable for the spinning-in operation, the sliver feed is engaged for a determined time interval before said yarn end is placed on the fiber band, the yarn is again drawn away, the feed is then interrupted again, and finally again engaged only for the spinning-in operation properly.

During the first sliver feed, lasting for a predetermined time interval, the singled-out fibers, comprising the damaged fibers of the fiber end section, are led away due to the underpressure existing in the underpressure chamber through the resting rotor into the underpressure chamber and from it into the suction tube. The rotor must be stopped in this phase.

Problematical in this solution is the removal of all damaged fibers from the combing roller clothing and from the rotor.

For this reason, a device has been developed, described in WO 86/01235, in which an ancillary suction channel enters into the fiber transport channel provided around the combing roller clothing. The ancillary suction channel enters behind the fiber feed channel, supplying the fibers into the rotor, seen in the direction of rotation. The ancillary suction channel is connectable to the underpressure source during the sliver pre-feed, and when the underpressure is applied to the ancillary suction channel, the pressurized air supply into the underpressure chamber of the rotor is interrupted so that the fibers are being sucked into the ancillary suction channel.

In spite of its considerably complex design, the chief drawback of this solution consists of the fact that not all impurities sticking to the clothing of the combing roller can be perfectly removed.

SUMMARY OF THE INVENTION

The above drawbacks of the state of the art are overcome by the method according to the invention in which, prior to the rotor start, a pressurized air stream acts upon the surface of the combing roller in the direction of rotation of the combing roller. The air stream is applied between the place of sliver supply to the combing roller and the mouth of the feed channel to the rotor, thus removing sticking impurities and sliver fibers from the combing roller clothing.

The turbulence of the pressurized air stream and its speed of streaming perfectly remove fibers and impurities from the combing roller clothing with the use of only a very small amount of air.

It is advantageous to act on the combing roller clothing with the pressurized air stream in front of the mouth of the waste channel into which all the pressurized air is fed together with the impurities. This method can be used in either of the two types of open-end spinning machines.

In machines with the passive rotor, the pressurized air stream acts upon the combing roller clothing in front of the mouth of the fiber feed channel to the rotor, into which all pressurized air is led together with fibers and impurities. These are then sucked into the main suction channel.

In the above-described methods of the present invention, it is advantageous if the air stream is supplied in a direction tangential to the surface of the combing roller.

It is also advantageous if the pressurized air stream action on the combing roller clothing begins, at the latest, simultaneously with the start of the sliver feed device, in order to prevent the clothing of the combing roller from being clogged by fibers.

The device for carrying out the method according to the invention consists in a closable, ancillary, pressurized-air feed channel leading into the fiber transport channel in the direction of rotation of the combing roller, and located between the sliver supply and the sliver feed channel into the rotor.

Especially in the open-ended spinning machines with active rotors, it is advantageous if the closable ancillary pressurized-air feed channel leads into the transport channel between the sliver feed device and the waste channel.

In open-end spinning machines with passive rotors, it is advantageous if the closable ancillary pressurized-air feed channel leads into the fiber transport channel in the direction of rotation of the combing roller and before the sliver feed channel to the rotor.

Alternatively, the ancillary pressurized-air feed channel can be made in the body of the singling-out device, and its inner space connected to the fiber transport channel is closable by a back valve.

In another variant, the ancillary pressurized-air feed channel can be made in the body of the condenser of the sliver feed device, and its inner space connected to the fiber transport channel is closable by a back valve.

On its outer side, the back valve can be adapted to receive a pressurized air duct that can be seated on a servicing device, at least the pressurized air duct end serving to be connected to the back valve can be situated on the servicing device adjustably.

It is advantageous if the ancillary pressurized air feed channel leads into the fiber transport channel with at least one jet in which the air stream speed and, consequently, the effectiveness of the cleaning of the combing roller clothing after the air entry into the fiber transport channel, are increased.

Perfect cleaning is obtained by leading the connecting end part of the ancillary pressurized air feed channel into the fiber transport channel in the direction of rotation of the combing roller. Especially in the open-end spinning machines with active rotors, the connecting end part of the ancillary pressurized air feed channel can go into the waste channel. In open-end spinning machines with passive rotors, it can go into the fiber feed channel to the rotor.

Other features and advantages of the present invention will become apparent from the following description of the invention which refers to the accompanying drawings.

BRIEF DESCRIPTION OF THE DRAWINGS

Examples of embodiments of the device according to the invention are shown in the accompanying drawings, in which.

DETAILED DESCRIPTION OF THE PREFERRED EMBODIMENTS

Figure 1:
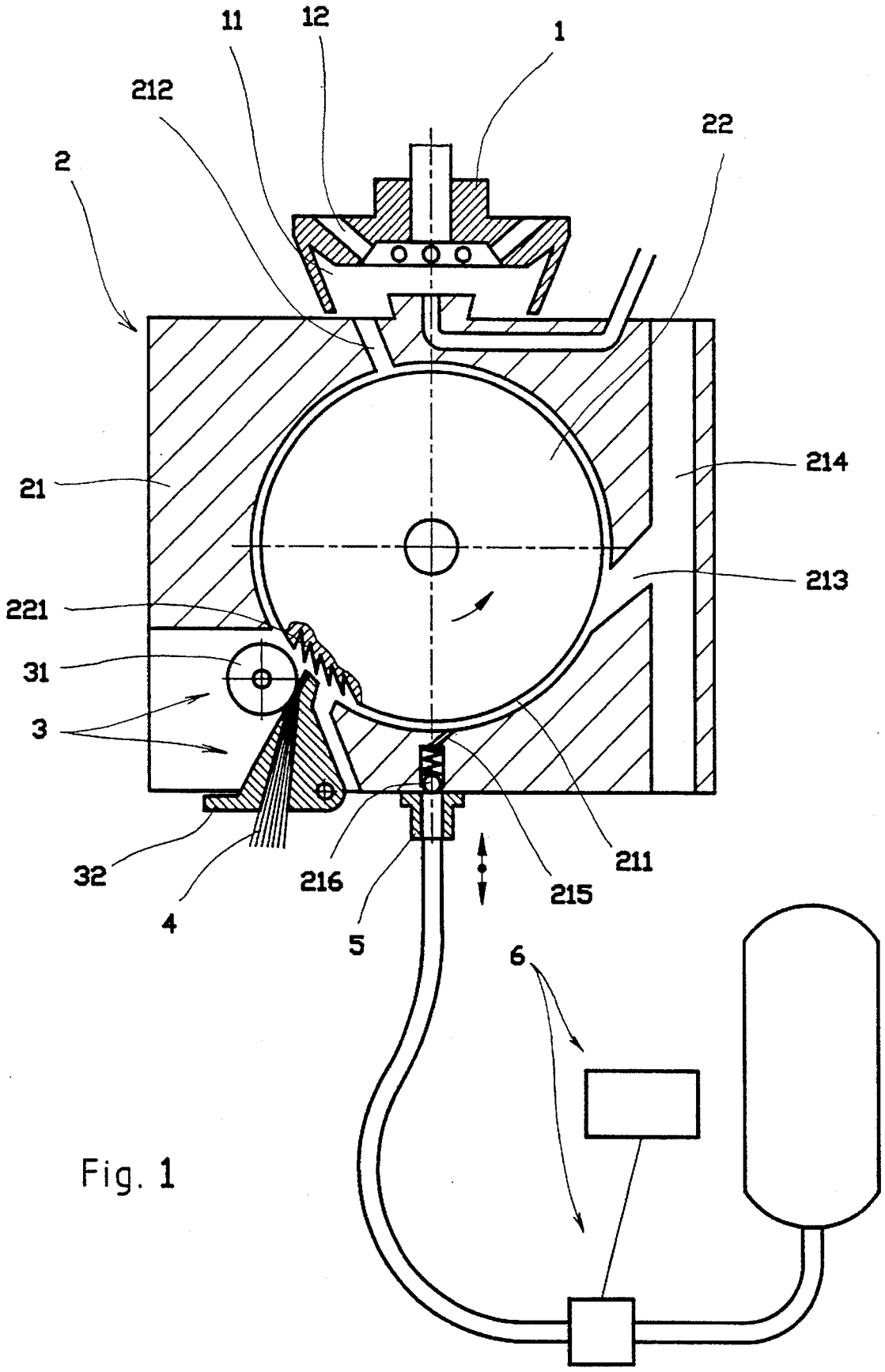
FIG. 1 is a section through a spinning unit with an active rotor with an ancillary pressurized-air feed channel situated in the body of a singling-out device.

The open-end spinning machine according to a preferred embodiment of the present invention, consists of a plurality of working places situated side by side, each of which is an independent unit serving to produce yarn from a sliver supply and to wind the yarn onto a cross-wound bobbin.

Each working place comprises a spinning unit serving for the yarn production proper. The spinning unit comprises a rotatably seated rotor 1 with its related singling-out device 2 consisting of a body 21 of the singling-out device 2. Rotatably seated in the singling-out device is a combing roller 22, whose cylindrical circumferential surface is fitted with a clothing 221 consisting, for instance, of teeth or needles. Around the clothing 221 of the combing roller 22 is provided a fiber transport channel 211. In the body 21 of the singling-out device 2 is also provided a fiber feed channel 212 to the rotor 1 whose beginning is connected to the fiber transport channel 211 and whose end is connected to the inner space of the rotor 1.

To the combing roller 22 is related a well-known sliver feed device 3 feeding a sliver 4 and interrupting the fiber transport channel 211. The feed device 3 comprises a feed roller 31, rotatably mounted in the body 21 of the singling-out device 2, and a condenser 32, also rotatably mounted in the body 21 of the singling-out device 2. The condenser 32 is in a well-known manner pressed onto the feed roller 31 that is connected to a drive, not shown, by means of an electromagnetic clutch, also not shown. Also, the combing roller 22 and the rotor 1 are in a well-known manner connected to their not shown well-known drive means.

In the embodiment shown in FIG. 1, the spinning unit comprises the rotor 1 equipped with ventilation apertures 12 for generating underpressure in the inner space 11 of the rotor 1. In the body 21 is, in a well-known manner, provided a waste channel 213, for taking away impurities from the fiber transport channel 211 fed by the clothing 221 of the combing roller 22, together with the fibers. The beginning of the waste channel 213 is connected with the fiber transport channel 211 in the direction of rotation of the combing roller 22 between the feed device 3 of the sliver 4 and the fiber feed channel 212 to the rotor 1. The waste channel 213 is, in a well-known manner, connected to a source of underpressure, for instance by being connected to an underpressure channel 214.

To the fiber channel 211 is connected, between the sliver feed device 3 and the waste channel 213, an ancillary pressurized air feed channel 215 provided in the body 21 of the singling-out device 2. The inner space of the ancillary pressurized air feed channel 215, connected to the fiber transport channel 211, is closed by a back valve 216 adapted on the outer side of the body 21 of the singling-out device 2 for receiving a pressurized air supply 5 mounted on a servicing device 6 carrying also a pressurized air source to which the pressurized air supply 5 is connected. At least the end section of the pressurized air supply 5 serving for connection to the back valve 216 is, on the servicing device 6, mounted adjustably.

The ancillary pressurized air feed channel 215 leads into the fiber transport channel 211 as one aperture or a plurality of side-by-side situated, small diameter apertures, or also as one or several jets. The purpose of this arrangement is to obtain the required speed with which the air stream shall enter the fiber transport channel 211.

The air stream flowing from the ancillary pressurized air feed channel 215 into the fiber transport channel 211 is directed onto the clothing 221 of the combing roller 22 in the sense of rotation of the combing roller 22. From the point of view of the cleaning of the clothing 221 of the combing roller 22, it is most advantageous if the air stream is in a tangential direction to the clothing 221 of the combing roller, or in a secant to the clothing 221.

For the spinning unit with the rotor 1 fitted with ventilation apertures 12, as shown in FIG. 1, the ancillary pressurized air feed channel 215 leads, in the most advantageous variant, into the fiber transport channel 211.

The air stream flowing out of the ancillary pressurized air feed channel 215 is directed into the waste channel 213 across or around the clothing 221 of the combing roller 22.

Figure 2:
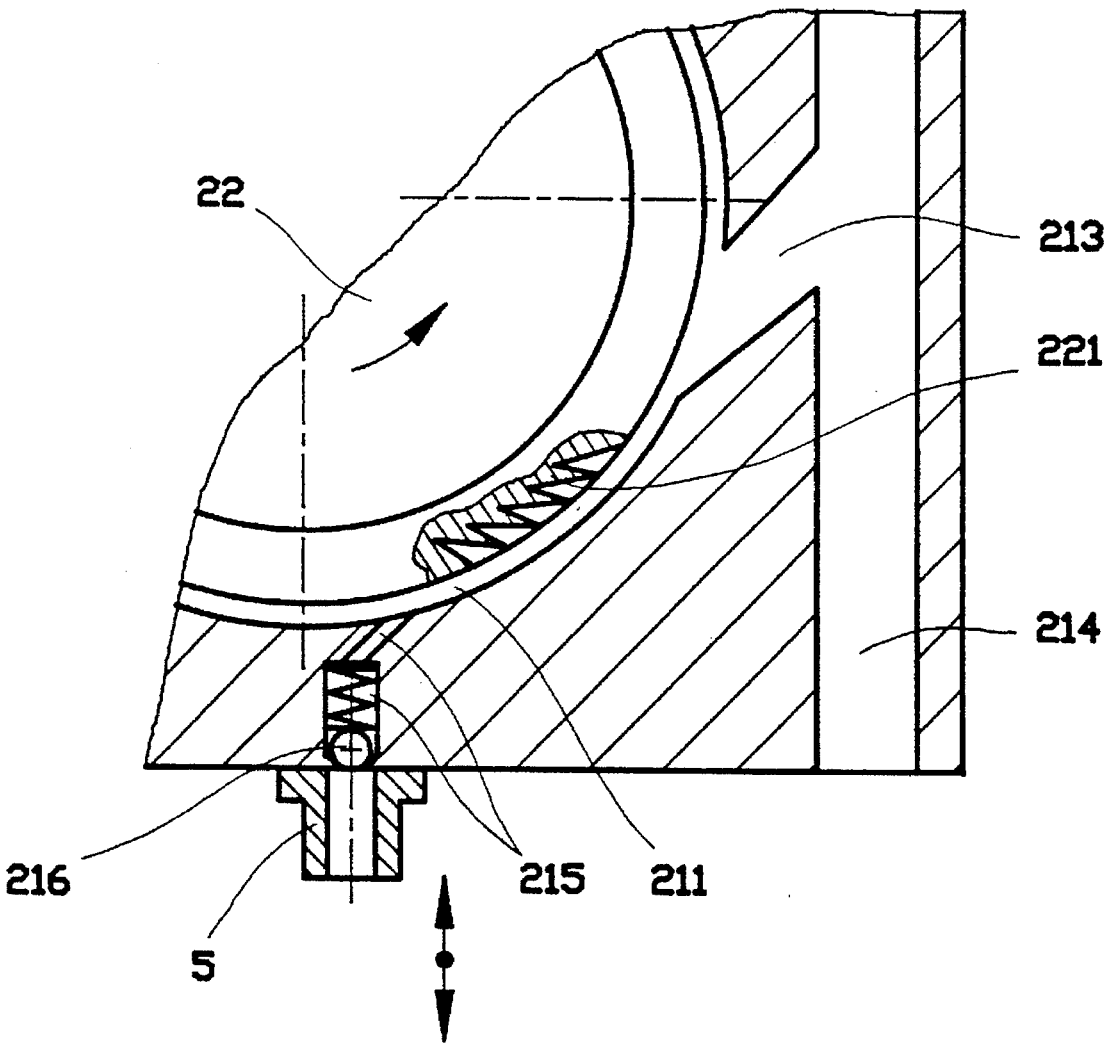
FIG. 2 shows details of the singling-out device according to FIG. 1.

In the embodiment shown in FIGS. 1 and 2, the ancillary, pressurized air feed channel 215 is made in the body 21 of the singling-out device 2.

Figure 3:
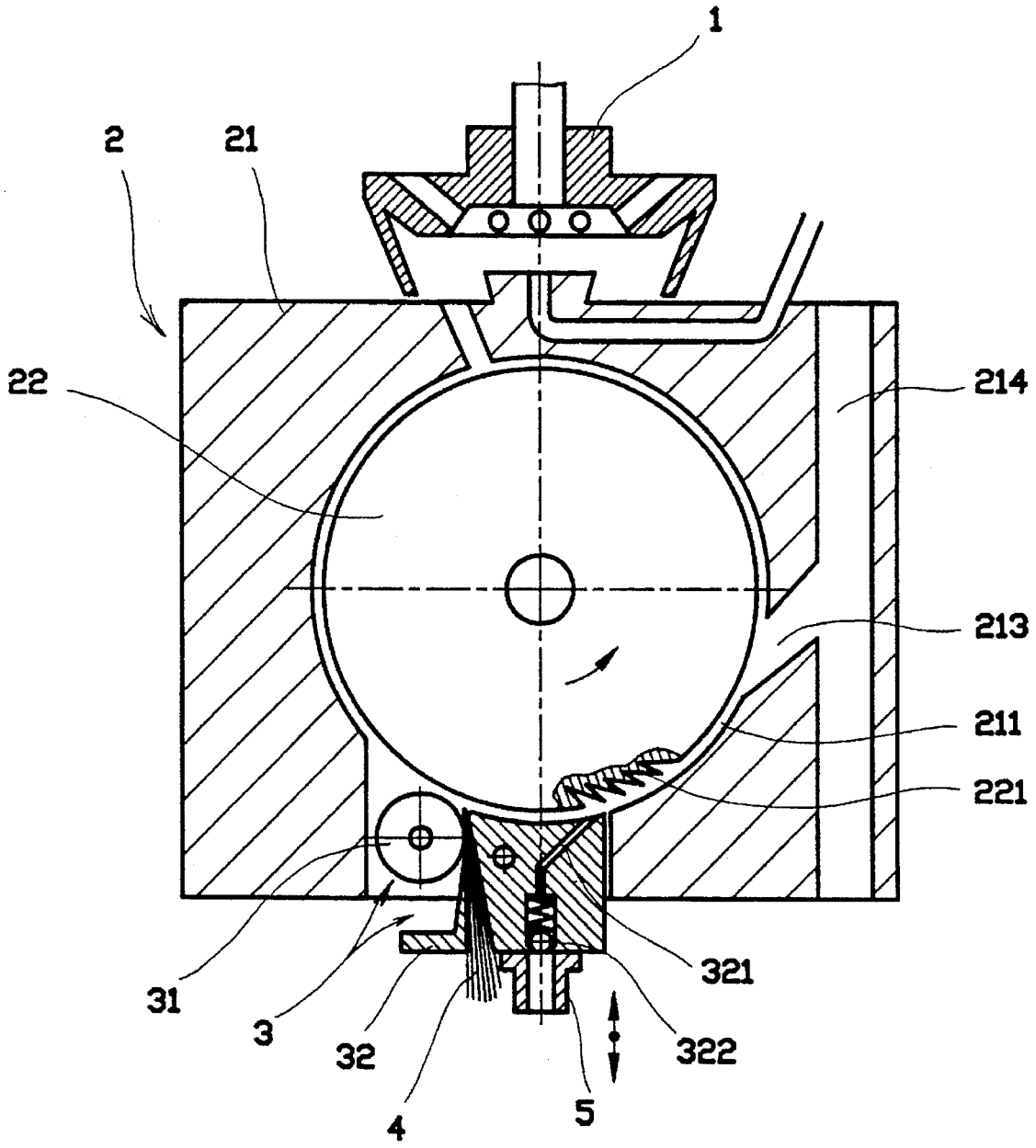
FIG. 3 shows an alternative embodiment of the device for a spinning unit with an active rotor in which the ancillary pressurized air feed channel is situated in the body of the condenser of the feed device.

For design or technological reasons, it may sometimes be more convenient to make an ancillary, pressurized air feed channel 321 in the body of the condenser 32 of the feed device 3 of the sliver 4, as shown in FIG. 3. In the body of the condenser 32 is provided also a back valve 322 closing the ancillary pressurized air feed channel 321 and adapted in its outer section to receive detachably the pressurized air supply 5. The mouth of the ancillary pressurized air feed channel 321 leading into the fiber transport channel 211 can be made in the same manner as in the preceding embodiment, which applies also to the direction of the stream going out of the ancillary pressurized air feed channel 321.

Figure 4:
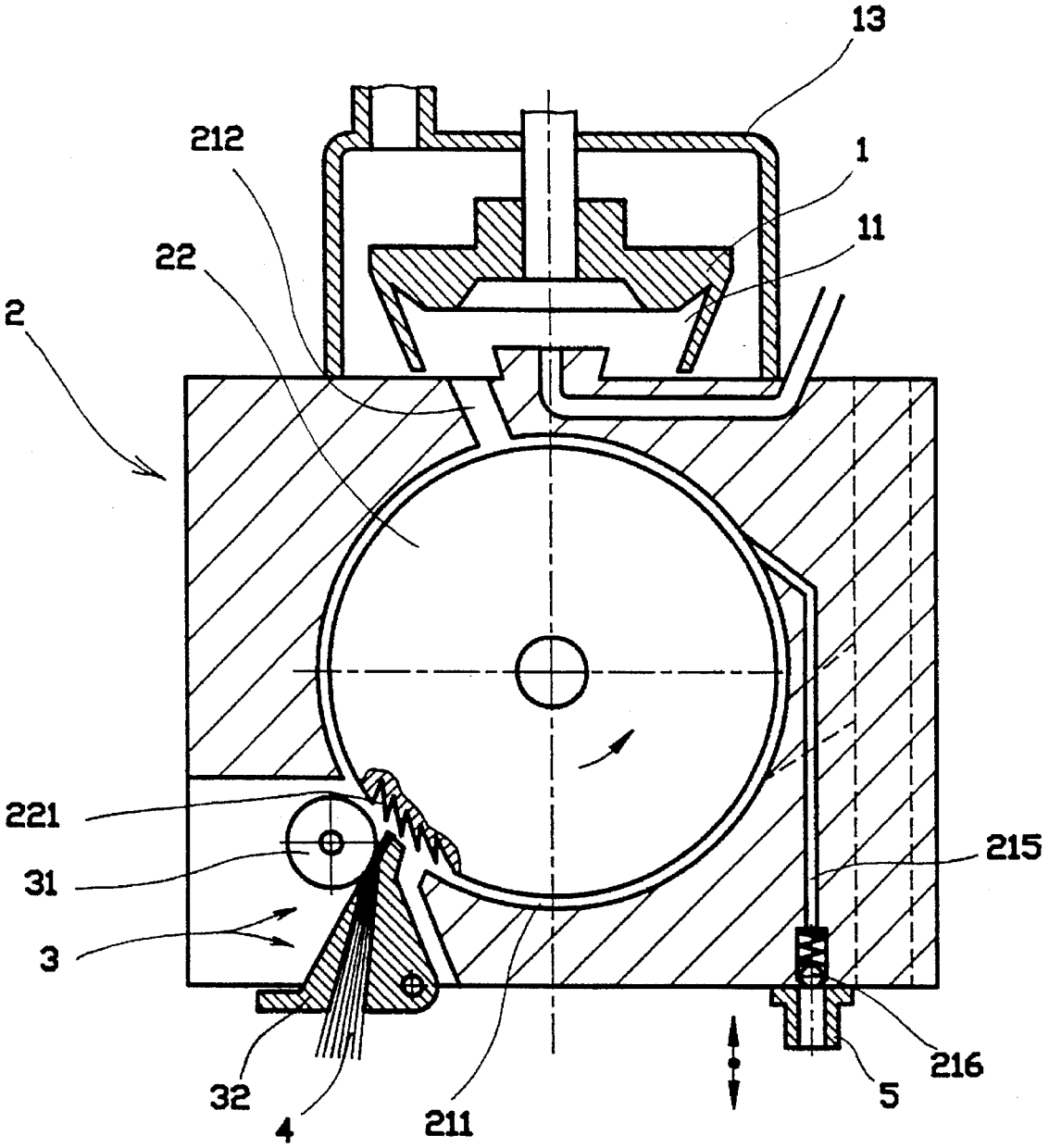
FIG. 4 shows a section through a spinning unit with a passive rotor.

In the embodiment shown in FIG. 4, the rotor 1 of the spinning unit is seated in an underpressure chamber 13 that is, in a well-known way, connected to a not shown underpressure source serving also to generate the technologically indispensable underpressure in the rotor, which is, in this embodiment, fitted with no ventilation apertures. The ancillary, pressurized air feed channel 215 is made in the body 21 of the singling-out device 2 and enters the fiber transport channel 211 between the waste channel 213 and the fiber feed channel 212 to the rotor 1. The other parts of the device are made like those of the embodiment shown in FIG. 1. The ancillary pressurized air feed channel 215 has, at its end on the front side of the body 21 of the singling-out device 2, the back valve 216 whose front part is adapted detachably to receive the pressurized air supply 5 from the servicing device 6.

Also, this embodiment permits the air stream flowing out of the ancillary pressurized air feed channel 215 into the fiber feed channel 212 to the rotor 1 to flow in the tangential or secant direction with respect to the clothing 221 of the combing roller 22.

In the spinning unit with the rotor 1 arranged in the underpressure chamber 13, the waste channel 213 can be situated behind the fiber feed channel 212 to the rotor 1 in the direction of rotation of the combing roller 1. In this embodiment, shown schematically, the ancillary pressurized air feed channel 215 leads into the fiber transport channel 211 in the direction of rotation of the combing roller 22 before the fiber feed channel 212 to the rotor 1.

In practice, when the yarn breaks or the bobbin is fully wound, the operation of the spinning unit in question is interrupted, i.e., the feed device 3 of the sliver 4, as well as the not shown yarn draw-off and winding device, stop. In active open-end spinning machines, in which the underpressure in the rotor is generated by the ventilation apertures in the rotor, the combing roller 22 of the singling-out device 2 keeps turning even after the sliver feed device stops so that the combing roller 22 gradually breaks off and tears out fibers from the end of the sliver 4 firmly gripped between the feed roller 31 and the condenser 32 of the sliver feed device 3. The part of the sliver 4 which reaches out of the grip between the feed roller 31 and the condenser 32 of the feed device 3, has been referred to herein as the fiber end section of the sliver. Damaged fibers are, through the fiber transport channel 211 and through the fiber feed channel 212 to the rotor 1, fed into the revolving rotor 1 and assembled there up to the time when the servicing device 6 comes, in a well-known manner cleans the rotor 1, and connects the pressurized air supply 5 to the back valve 216 of the spinning unit in question. A small part of the damaged fibers remains on the cover 221 of the combing roller 22.

During the cleaning of the rotor 1 or immediately after it is finished, before the resumption of the underpressure in the rotor 1 by its resuming the revolving motion, the servicing device 6 opens the pressurized air supply 5, and thus brings pressurized air to the back valve 216 and through it into the ancillary pressurized air feed channel 215 out of which the pressurized air stream flows through the jets in the direction of rotation of the combing roller 22 into the fiber transport channel 211. The velocity of this pressurized air stream preferably is greater than the circumferential velocity of the clothing 221 of the combing roller 22, so that it tears off from the toothed elements of the clothing 221 the fibers combed out of the fiber end section of the sliver 4, as well as other impurities stuck to the clothing 221, and carries and delivers them to the waste channel 213. During the pressurized air supply to the ancillary pressurized air feed channel 215, or immediately before the feed device 3 is started. Thus, all damaged and shortened fibers of the fiber end section are removed from the clothing 221 of the combing roller 22, delivered by the pressurized air stream into the waste channel 213, and from there by the underpressure channel 214 to a waste deposit.

In the meantime, the servicing device 6 prepares in a well-known manner the working place and the free yarn end for respinning in. When the operation speed of the rotor has been reached, the pressurized air supply is interrupted to the back valve 216 and, consequently, to the ancillary, pressurized air feed channel 215, and the combed out fibers are carried through the fiber transport channel 211 and through the fiber feed channel 212 to the rotor 1 whereupon the yarn is, in a well-known manner, spun-in, and the working place resumes its normal operation.

In the embodiment shown in FIG. 4, in which the rotor 1, having no ventilation apertures, is seated in a vacuum in the underpressure chamber 13, fibers are fed to the rotating rotor 1 through the fiber feed channel 212 due to the vacuum existing in the underpressure chamber 13. Upon yarn rupture, the rotor 1 stops, together with the feed device 3 of the sliver 4. After the stop of the rotor 1, the remaining fibers are sucked from it at least due to the underpressure existing in the underpressure chamber 13. The combing roller 22 keeps turning and damages the fiber end section of the immobilized sliver 4. By means of underpressure, the damaged combed out fibers are sucked into the inner space of the underpressure chamber 13. However, some of them may stick to the clothing 221 of the combing roller 22. The servicing device 6, upon its arrival, puts into operation for a predetermined time period the feed device 3 of the sliver 4 so as to remove the fiber end section of the sliver 4 with its damaged fibers, and simultaneously connects the pressurized air supply 5 to the back valve 216 so as to force into the ancillary pressurized air feed channel 215 pressurized air whose stream flows out of this channel 215 in the direction of rotation of the combing roller 22 into the fiber transport channel 211, and is directed into the fiber feed channel 212 to the rotor 1, thus perfectly freeing the clothing 221 of the combing roller 22 from all the fibers, rests thereof, and sticking impurities, which are delivered through the fiber feed channel 212 to the immobilized rotor 1, and from it to the underpressure chamber 13 out of which they are sucked away in a well-known manner.

After the stop of the feed device 3, and after removal of all fibers from both the clothing 221 of the combing roller 22 and the rotor 1, the pressurized air supply to the ancillary pressurized air feed channel 215 is interrupted, and then the rotor 1 is restarted.

After the rotor 1 has reached its predetermined speed of rotation, the pressurized air supply is interrupted to the back valve 216 and, consequently, to the ancillary pressurized air feed channel 215. The yarn end is inserted into the rotor 1, and in the well-known sequence carried out the subsequent, well-known spinning-in operations.

The fact that the spinning-in is carried out with non-shortened fibers, of the same quality as those used in current yarn, results in high strength, undisturbed appearance, and outstanding quality of the spinning-in connecting section, especially when spinning fine yarns.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A method of spinning-in yarn on open-ended spinning machines including a singling-out device having a combing roller with a surface covered by a clothing, a rotor having a direction of rotation, a sliver supply for supplying a sliver, and a fiber feed channel having a mouth, in which an interruption of the spinning process is followed by the stop of the sliver feed into the singling-out device whose combing roller keeps turning, and prior to resuming the spinning process, the rotor is stopped at least during cleaning, and when the rotor has re-started a yarn end is returned to it and brought into contact with a fiber band in process of formation, the method comprising the steps of:

supplying a pressurized air stream onto the clothing surface of the combing roller in the direction of rotation of the combing roller, and between the sliver supply to the combing roller and the mouth of the fiber feed channel to the rotor, the pressurized air being supplied beginning prior to the start of the rotor and at the latest simultaneously with the start of the feed device, thus removing from the clothing of the combing roller sticking impurities and fibers of the sliver.

2. A method as claimed in claim 1, wherein:

the spinning-in device includes a waste channel; and the pressurized air stream is supplied upon the clothing of the combing roller in front of a mouth of the waste channel, the pressurized air together with the impurities being led into the waste channel.

3. A method as claimed in claim 1, wherein:

the pressurized air is supplied with the rotor at rest; and the pressurized air stream is supplied upon the clothing of the combing roller at a position prior to the mouth of the fiber feed channel to the rotor with respect to the direction of rotation of the combing roller, all pressurized air being led together with impurities and fibers into the fiber feed channel to the rotor.

4. A method as claimed in claim 1, wherein the air stream is supplied in a direction tangential to the clothing of the combing roller.

5. A method as claimed in claim 1, wherein the supply of the pressurized air stream on the clothing of the combing roller begins simultaneously with the start of the feeding by the feed device of the sliver.

6. A spinning-in device provided in a singling-out device of a spinning unit of an open-end spinning machine, the singling-out device including a body having disposed thereon a rotor and a rotatably mounted combing roller, the combing roller having a direction of rotation and a cylindrical surface fitted with a clothing, and around the cylindrical surface of the combing roller there is provided a fiber transport channel that connects to a fiber feed channel to the rotor, the combing roller having related thereto a sliver feed device for supplying a sliver to the fiber transport channel, the sliver feed device including a condenser having a body, the spinning-in device comprising:

a closable ancillary pressurized air feed channel made in the body of the condenser of the sliver feed device, the pressurized air feed channel being connected to the fiber transport channel to supply pressurized air to the fiber transport channel in the direction of rotation of the combing roller, the pressurized air feed channel being positioned between a place of supply of the sliver and the fiber feed channel to the rotor; and a waste channel for removing impurities connected to the fiber transport channel, the fiber transport channel conducting the pressurized air around the cylindrical surface of the combing roller, in the direction of rotation of the combing roller, directly to the waste channel.

7. A spinning-in device as claimed in claim 6, wherein the closable ancillary pressurized air feed channel connected through its mouth to the fiber transport channel is positioned before the fiber feed channel to the rotor with respect to the direction of rotation of the combing roller.

8. A spinning-in device as claimed in claim 6, wherein:

the ancillary pressurized air feed channel is made in the body of the singling-out device and has an inner space connected to the fiber transport channel; and the inner space of the pressurized air feed channel is closed by a back valve.

9. A device as claimed in claim 8, wherein:

the back valve is on the outer side of the body of the singling-out device; and the outer side of the body of the singling-out device is adapted to receive a pressurized air supply duct.

10. A device as claimed in claim 9, wherein:

the pressurized air supply duct to be received by the outer side of the body of the singling-out device is seated on a servicing device; and the pressurized air supply duct has an end serving to connect it to said back valve, and the end is seated on the servicing device adjustably.

11. A device as claimed in claim 6, wherein the ancillary pressurized air feed channel includes at least one air jet, and opens into the fiber transport channel with the at least one jet.

12. A device as claimed in claim 6, wherein the air feed channel is positioned to direct the pressurized air in a direction tangential to the cylindrical surface of the combing roller.

* * * * *